US011064584B2

(12) United States Patent
Yang

(10) Patent No.: US 11,064,584 B2
(45) Date of Patent: Jul. 13, 2021

(54) REMOTE CONTROL

(71) Applicant: JETMAX LIGHTING INDUSTRIAL CO., LIMITED, Guangdong (CN)

(72) Inventor: Ping Yang, Guangdong (CN)

(73) Assignee: JETMAX LIGHTING INDUSTRIAL CO., LIMITED, Dongguan (CN)

( * ) Notice: Subject to any disclaimer, the term of this patent is extended or adjusted under 35 U.S.C. 154(b) by 61 days.

(21) Appl. No.: 16/691,507

(22) Filed: Nov. 21, 2019

(65) Prior Publication Data

US 2021/0160974 A1 May 27, 2021

(51) Int. Cl.
*H05B 45/20* (2020.01)
*H05B 47/19* (2020.01)

(52) U.S. Cl.
CPC ..... *H05B 45/20* (2020.01); *H05B 47/19* (2020.01)

(58) Field of Classification Search
None
See application file for complete search history.

(56) References Cited

U.S. PATENT DOCUMENTS 9,955,545 B1 * 4/2018 Chang ..... H05B 45/20
10,728,994 B1 * 7/2020 Yang ..... H05B 45/37
2014/0196090 A1 * 7/2014 Kataoka ..... H04N 21/84 725/43

* cited by examiner

*Primary Examiner* — Amy Cohen Johnson
*Assistant Examiner* — Jianzi Chen
(74) *Attorney, Agent, or Firm* — Pai Patent & Trademark Law Firm; Chao-Chang David Pai

(57) ABSTRACT

The invention relates to a remote control for remotely controlling the illumination of an LED string; the remote control has a control panel having a dial selector for selecting a color of a primary color light emitted by the LED string, a plurality of first color illumination mode buttons, a plurality of background illumination mode buttons, and an illumination sequence button; the remote control has a control circuit having a wireless transmitter for transmitting an LED string control signal to the LED string; a resistive divider circuit providing a plurality of divided voltages to the dial selector which selects one of the divided voltages as an output voltage, a plurality of switches each outputting a state voltage, and a controller connected to the wireless transmitter, the dial selector and the plurality of switches to generate the LED string control signal.

18 Claims, 4 Drawing Sheets

REMOTE CONTROL

BACKGROUND OF THE INVENTION

1. Field of the Invention

The present invention is related to a device for controlling the illumination of a remote LED string, especially about a remote control.

2. Description of the Related Art

A wide variety of light emitting diode (LED) strings have been broadly used in interior decoration and outdoor decoration. For example, Christmas trees with LED strings have become a must-have decoration for Christmas. Nowadays, as the blue LEDs are fully popular, the LED strings with all the rainbow colors have become the main stream, so it is necessary for an LED string controller to control such kind of multi-color LED strings to produce a variety of appealing visual effects. Such an LED string controller has a certain degree of complexity and a wireless interface should be necessary to facilitate user operations. FIG. 3 shows a commonly available LED string remote control having thirty-nine visual effect options. When the user selects one of the thirty-nine visual effect options by using the four buttons ↑→↓←, the selected option will have one corresponding LED that illuminates. Since the LED string remote control lists all the visual effect options directly on its front surface, it will be difficult for such a remote control to include too many options, let alone the required LED and the front surface size of the remote control will also increase proportionally, therefore the cost of the LED string remote control will also increase. As the types of visual effects are sure to increase, it is necessary to improve the remote control to make it more capable of accommodating more new options while still maintaining similar costs.

SUMMARY OF THE INVENTION

In view of the difficulties in expanding new options of the conventional LED string remote control, the present invention provides a remote control that can easily add new options to resolve the issue of the new option expansion for the existing LED string remote control and to simultaneously reduce costs. To be more specific, a remote control of the present invention is disclosed herein.

A remote control for remotely controlling illumination of an LED string includes:

a control panel including:

a dial selector including a plurality of selection positions for selecting a color of a primary color light emitted by the LED string;

a plurality of primary color illumination mode buttons for selecting an illumination mode of the primary color light;

a plurality of background illumination mode buttons for selecting an illumination mode of a background color light emitted by the LED string to cooperate with the primary color light;

an illumination sequence button cooperating with the dial selector to select an illumination sequence of LED lamps in the LED string;

a control circuit including:

a wireless transmitter for transmitting an LED string control signal to control the LED string via an antenna;

a resistive divider circuit for providing a plurality of divided voltages to the dial selector, wherein the dial selector selects one of the plurality of divided voltages as an output voltage;

a plurality of switches, each of which having two ends and one button, wherein the buttons of the plurality of switches are either the primary color illumination mode buttons, the background illumination mode buttons, the illumination sequence button, or an on/off button, and the plurality of switches are configured to output state voltages;

a controller electrically connected to the wireless transmitter and providing the LED string control signal to the wireless transmitter, the controller electrically connected to the dial selector to receive the output voltage from the dial selector, and the controller electrically connected to the plurality of switches for detecting the state voltages of each of the plurality of switches, wherein the controller generates the LED string control signal according to both the output voltage of the dial selector and the state voltages output by the plurality of switches.

Wherein the color of the primary color light includes: red, yellow, blue, green, cyan, purple or white, or any combination of red, yellow, blue, green, cyan, and purple.

Wherein the illumination mode of the primary color light includes that the primary color light has a fixed color that does not change with time, or that the primary color light has a fixed color that periodically and gradually gets brightened then dimmed.

Wherein the illumination mode of the background color light includes that the primary color light cooperates with a flashing background color light, or that the primary color light cooperates with a flashing background white light, or that the primary color light and a randomly selected background color light are flashing alternately.

Wherein the LED illumination sequence of the LED light string includes "sequentially on then reverse fading", or "in-wave twinkle forward and backward", or "sequentially blinking", or that the primary color light and another color light are together chasing, or that the primary color light and other two color lights are together chasing, or that the primary color light starting chasing from the middle of the LED string to its two ends, or "sequentially blinking and then sequentially off".

Wherein the resistive divider circuit includes: a resistor string composed of a plurality of resistors connected in series, wherein the connection of any two of the serially connected resistors is designated as a voltage output node, and the resistor string has two end points electrically connected to a high voltage and a low voltage, respectively; and all the voltage output nodes plus the two end points of the resistor string output the divided voltages of the resistive dividing circuit.

Wherein the state voltage includes: a digital high voltage, a ground potential, and a floating state voltage.

Wherein the dial selector includes: an output terminal, a selection input end and a turntable; the select input end being rotatable with the turntable to electrically connect to the plurality of selection positions respectively to conduct one of the plurality of divided voltages to the output terminal as the output voltage of the dial selector.

In short, by configuring the output voltage of the dial selector of the present invention to select either the light color of the primary color light or the illumination sequence of the LED string, a lot of input panel space and cost are thereby saved and the option expansion problems of the existing LED string remote controls are thus solved, and the object of the present invention can be achieved.

DETAILED DESCRIPTION OF THE INVENTION

These and other aspects of the embodiments herein will be better appreciated and understood when considered in conjunction with the following description and the accompanying drawings.

Figure 1:
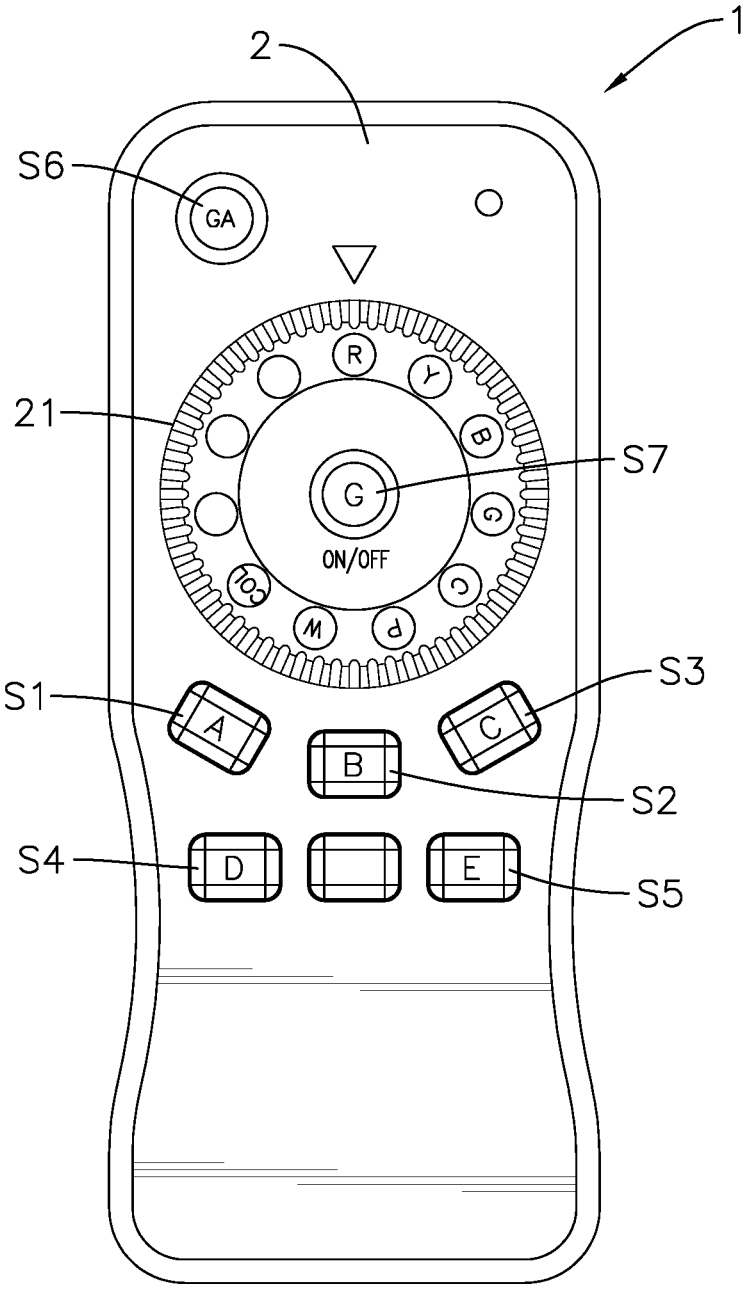
FIG. 1 is a schematic view of the appearance of the remote control of the present invention.
Figure 2A:
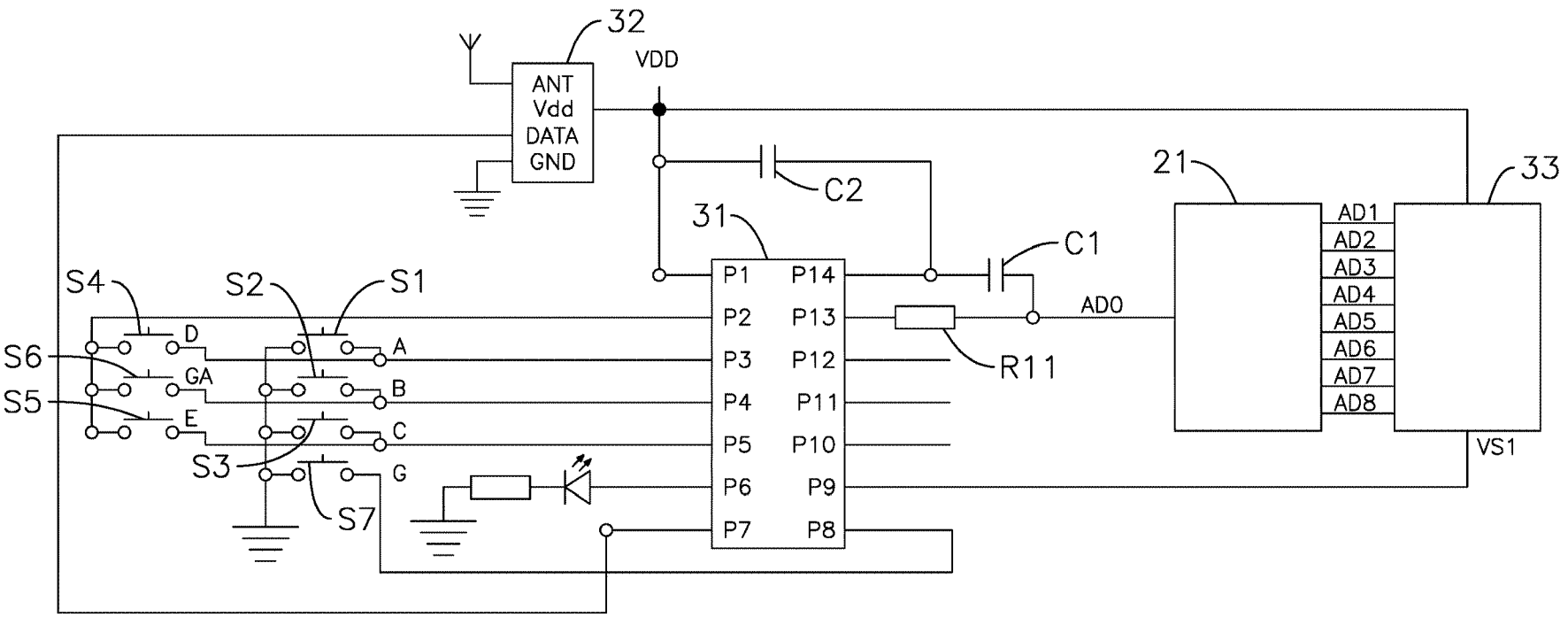
FIGS. 2A and 2B are circuit block diagrams of the remote control of the present invention.

Please refer to FIG. 1 and FIG. 2A. The present invention is a remote control 1 for remotely controlling the illumination of an LED string. The remote control 1 has a control panel 2 and a control circuit 3. The control panel 2 has a dial selector 21 and first to seventh buttons A, B, C, D, E, GA, G. The dial selector 21 has eight effective selection positions respectively labeled as R, Y, B, G, C, P, W, COL, the other selected positions of the dial selector 21 are invalid selection positions reserved for future expansion of new options, and the eight effective selection positions are used to select the color of a primary color light emitted by the LED string, for example, valid selection positions R, Y, B, G, C, P, W respectively represent that the color of the primary color light emitted by the LED string is red, yellow, blue, green, cyan, purple and white, and the effective selection position COL represents that the color of the primary color light emitted by the LED string is a mixture of six colors of red, yellow, blue, green, cyan and purple.

The first to seventh buttons A-E, GA and G are selections of various illumination modes, wherein the first button A represents the selection that the color of the primary color light does not change with time (i.e. a fixed color) and is steadily on. The second button B represents the selection that the color of the primary color light is a fixed color that periodically and gradually gets brightened then dimmed. The third button C represents the selection that both the primary color light and a flashing background color light are displayed simultaneously. The fourth button D represents the selection that both the primary color light and a flashing background white light are displayed simultaneously. The fifth button E represents the selection that both the primary color light and a randomly selected background color light are alternately flashing. The seventh button G is used to turn on/off both the remote control 1 and the LED string.

The sixth button GA and the dial selector 21 jointly select the order of illumination of the LED lamps in the LED strings, wherein selecting both the sixth button GA and the selection position R means that the LED string illumination sequence is "sequentially on then reverse fading"; while selecting both the sixth button GA and the selection position Y means the LED string illumination sequence is "in-wave twinkle forward and backward"; while selecting both the sixth button GA and the selection position B means that the LED string illumination sequence is "sequentially blinking"; while selecting the sixth button GA and the selection position G means the LED string illumination sequence is that the primary color light plus another color light are together chasing; while selecting the sixth button GA and the selection position C means that the LED string illumination sequence is that the primary color light plus two other color lights are together chasing; while selecting the sixth button GA and the selection position P means the LED string illumination sequence is that the primary color light starting chasing from the middle of the LED string to its two ends; and while selecting both the sixth button GA and the selection position W means the LED string illumination sequence is "sequentially blinking and then sequentially off".

Figure 2B:
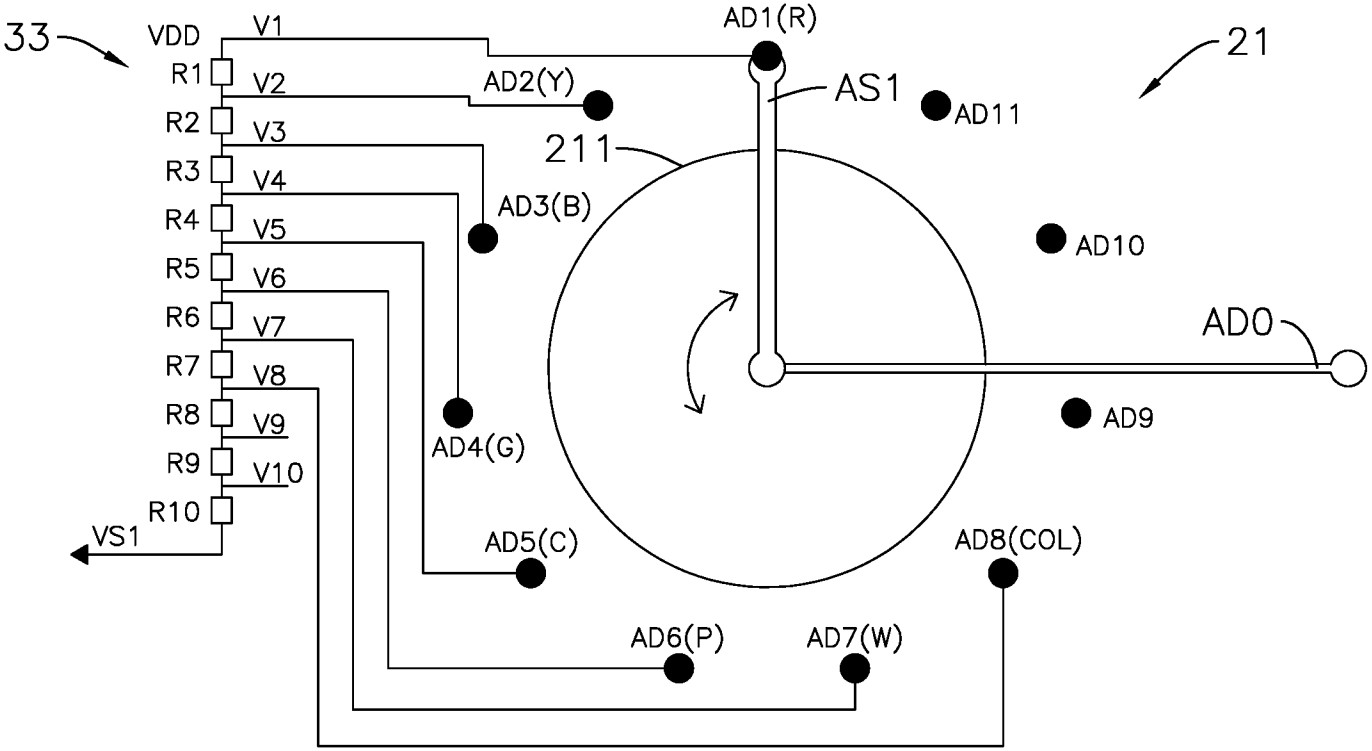
Figure 3:
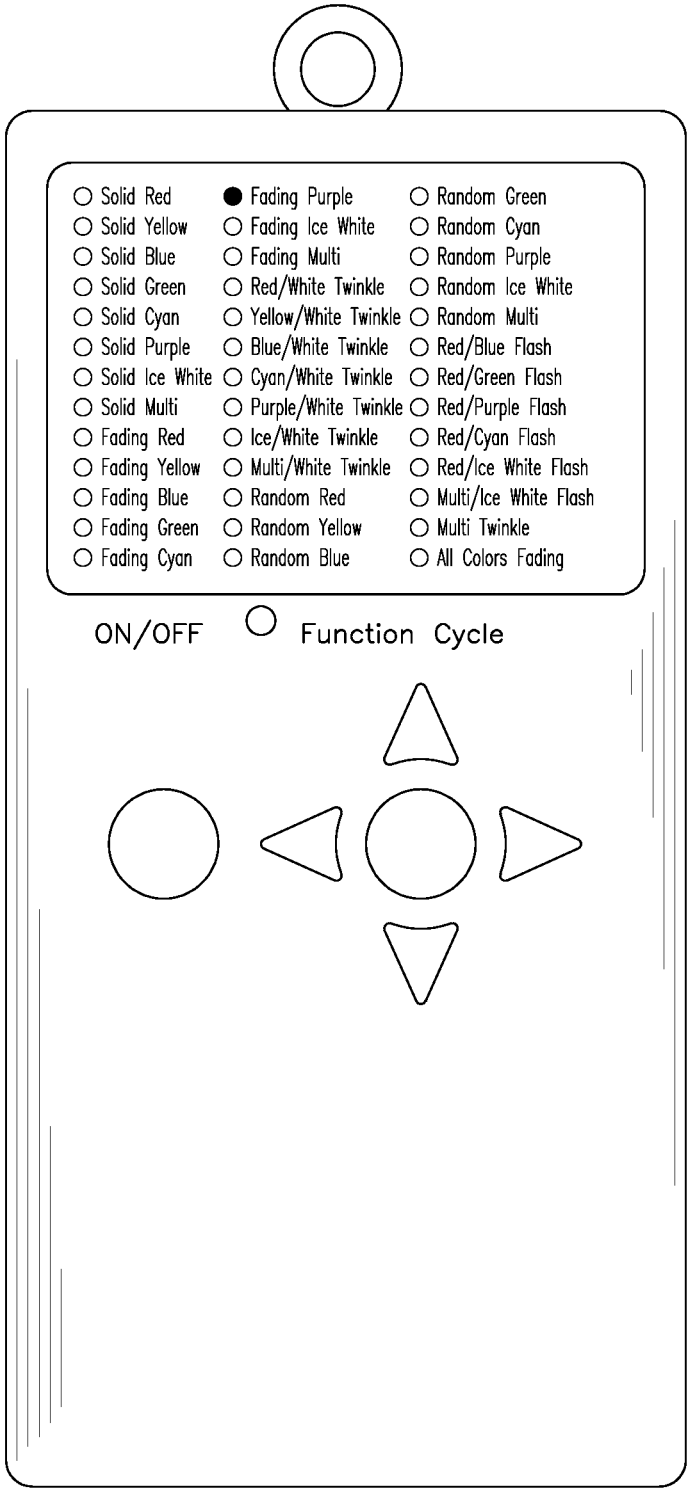
FIG. 3 is a schematic view of a prior art.

Referring to FIG. 2A and FIG. 2B, the control circuit 3 has a controller 31 having first to fourteenth terminals P1-P14. The control circuit 3 further has a wireless transmitting device 32 having an antenna output terminal ANT, a power input terminal Vdd, a ground terminal GND and a data terminal DATA, wherein the antenna output terminal ANT is connected with an antenna, and the power input terminal Vdd is connected to a DC power supply VDD, and the ground terminal GND is connected to an electric ground potential. The control circuit 3 further has an LED indicator 34 to indicate ON/OFF conditions of the remote control 1 as well as the LED string. The control circuit 3 further has a resistive divider circuit 33 which is formed by serially connecting first to tenth resistors R1-R10 with multiple wire extensions respectively to electrically connect to first to eighth effective selection terminals AD1-AD8 of the dial selector 21 which respectively further have first to third invalid selection terminals AD9-AD11. The control circuit 3 further has first to seventh switches S1-S7 which respectively have the first button A, the second button B, the third button C, the fourth button D, the fifth button E, the sixth button GA and the seventh button G The control circuit 3 further has an eleventh resistor R11, a twelfth resistor R12, a first capacitor C1 and a second capacitor C2.

In the resistive divider circuit 33, the first resistor to the tenth resistor R1-R10 each have two ends and a resistance value, wherein the resistance values of the first resistor to the tenth resistor R1-R10 may be the same or may be different. One end of the first resistor R1 is connected to a supply voltage VDD (i.e. a DC voltage source) as well as the first effective selection terminal AD1 having a V1 voltage, so the V1 voltage is equal to the VDD voltage. The other end of the first resistor R1 is electrically connected to one end of the second resistor R2 as well as the second effective selection terminal AD2, so the second effective selection terminal AD2 has a V2 voltage. Similarly, the other end of the second resistor R2 is electrically connected to one end of the third resistor R3 as well as the third effective selection terminal AD3 having a V3 voltage. The other end of the third resistor R3 is electrically connected to one end of the fourth resistor R4 as well as the fourth effective selection terminal AD4 having a V4 voltage. The other end of the fourth resistor R4 is electrically connected to one end of the fifth resistor R5 as well as the fifth effective selection terminal AD5 having a V5 voltage. The other end of the fifth resistor R5 is electrically connected to one end of the sixth resistor R6 as well as the sixth effective selection terminal AD6 having a V6 voltage. The other end of the sixth resistor R6 is electrically connected to one end of the seventh resistor R7 as well as the seventh effective selection terminal AD7 having a V7 voltage. The other end of the seventh resistor R7 is electrically connected to one end of the eighth resistor R8 as well as the eighth effective selection terminal AD8 having a V8 voltage. The other end of the eighth resistor R8 is electrically connected to one end of the ninth resistor R9 having a V9 voltage at the joint of the two resistors. The other end of the ninth resistor R9 is electrically connected to one end of the tenth resistor R10 having a V10 voltage at the joint of the two resistors. The other end of the tenth resistor R10 is electrically connected to the ninth terminal of the controller 31 having a VS1 voltage which may be the ground potential or a voltage between the ground potential and the supply voltage VDD. The V1 voltage to the V10 voltage and the VS1 voltage are designated as the divided voltages output by the resistive dividing circuit 33.

The dial selector 21 has an output terminal AD0 and a selection input terminal AS1 and a dial 211. The input selection terminal AS1 is fixed with the dial 211. When the user rotates the dial 211, the input selection terminal AS1 will follow the rotation of the dial 211. The output terminal AD0 is fixed and does not follow the movements of the dial 211. When the selection input terminal AS1 is rotated to the position of the first effective selection terminal AD1 which corresponds to the effective selection positions labeled as R, the first effective selection terminal AD1 and the input selection terminal AS1 are electrically connected, and the voltage V1 of the first effective selection terminal AD1 is passed to the output terminal AD0 via the input selection terminal AS1, and then the voltage V1 is input to the thirteenth terminal of the controller 31 via the eleventh resistor R11 Similarly, when the selection input terminal AS1 is respectively rotated to the positions of the second to the eighth effective selection terminals AD2-AD8, then the second effective selection terminal to the eighth effective selection terminal AD2-AD8 are respectively electrically connected with the selection input terminal AS1; hence the voltages V2-V8 of the second to the eighth effective selection terminals AD2-AD8 are respectively passed to the output terminal AD0 via the selection input AS1, and then the voltages V2-V8 are respectively input to the thirteenth terminal P13 of the controller 31 via the eleventh resistor R11.

The first switch to the seventh switch S1-S7 each have two terminals and a button. When the button is pressed, the two terminals will short circuit, otherwise the two terminals are open circuit, and more details are as follows.

The first switch S1 has the first button A, with one terminal being grounded, and the other terminal being electrically connected to the third terminal P3 of the controller 31; when the first button A is pressed, the voltage of the terminal P3 is pulled to the ground potential. The second switch S2 has the second button B, with one terminal being grounded, and the other terminal being electrically connected to the fourth terminal P4 of the controller 31; when the second button B is pressed, the voltage of the fourth terminal P4 is pulled to the ground potential. The third switch S3 has the third button C, with one terminal being grounded, and the other terminal being electrically connected to the fifth terminal P5 of the controller 31; when the third button C is pressed, the voltage of the fifth terminal P5 is pulled to the ground potential. The fourth switch S4 has the fourth button D, with one terminal being electrically connected to the second terminal P2 of the controller 31, wherein the second terminal P2 can output a digital high voltage Vh, and the other terminal of the fourth switch S4 is electrically connected to the third terminal P3 of the controller 31; when the fourth button D is pressed, the potential of the third terminal P3 is pulled to the digital high voltage Vh. The fifth switch S5 has the fifth button E, with one terminal being electrically connected to the second terminal P2 of the controller 31 and the other terminal being electrically connected to the fifth terminal P5 of the controller 31; when the fifth button E is pressed, the potential of the fifth terminal P5 is pulled to the digital high voltage Vh. The sixth switch S6 has the sixth button GA, with one terminal being electrically connected to the second terminal P2 of the controller 31 and the other terminal being electrically connected to the fourth terminal P4 of the controller 31; when the sixth button GA is pressed, the potential of the fourth terminal P4 is pulled to the digital high voltage Vh. The seventh switch S7 has the seventh button G, with one terminal being grounded, and the other terminal being electrically connected to the eighth terminal P8 of the controller 31; when the seventh button G is pressed, the voltage of the eighth terminal P8 is pulled to the ground potential. The seventh button G can turn on/off the remote control 1.

Following the above, the first to seventh switches S1 to S7 can individually provide a state voltage to the controller 31 according to whether the button is pressed. For example, when the first button A is pressed, a ground voltage is supplied to the third terminal P3, and when the fourth button D is pressed, a digital high voltage Vh is supplied to the third terminal P3, and when the first button A and the fourth button are not pressed, no fixed voltage is supplied to the third terminal P3, so it can be said that a floating state voltage is provided to the third terminal P3. Hence, the controller 31 can determine whether the first button A or the fourth button D is being pressed according to the voltages provided by the first button A and the fourth button D to the third terminal P3. Accordingly, the voltages supplied to the third terminal P3 by the first button A and the fourth button D can be referred to as the state voltages of the corresponding switches. Similarly, the voltages provided by the second button B and the sixth button GA to the fourth terminal P4 can be referred to as the state voltages of the corresponding switches. The voltages that the third button C and the fifth button E provide to the fifth terminal P5 may be referred to as the state voltages of the corresponding switches, and the voltages that the seventh button G provides to the eighth terminal P8 may be referred to as the state voltages of the corresponding switch.

The controller 31 controls various displaying modes of the LED lamps in the LED string according to the voltage detected at the thirteenth terminal P13, wherein the voltage at the thirteenth terminal P13 is supplied by the output terminal AD0 through the eleventh resistor R11. The controller 31 also controls additional displaying modes of the LED lamps in the LED string according to the state voltages provided by the first switch to the seventh buttons A-E, GA, G. When the sixth button GA is pressed, the potential of the fourth terminal P4 of the controller 31 is pulled to the digital high potential Vh, then the controller 31 will determine the order of illumination of the LED lamps in the LED string according to the voltage detected at the thirteenth terminal P13, and when the sixth button GA is not pressed, the voltage of the fourth terminal P4 of the controller 31 is not the digital high potential Vh, then the controller 31 will determine the color of the primary color light emitted by the LED string according to the voltage detected at the thirteenth terminal P13.

The output voltage of the dial selector 21 of the present invention can be used to select the light color of the primary color light or the order of illumination of the LED string, depending on the status of a selection switch, thereby saving a lot of input panel space and cost comparing with conventional LED string remote controls which list all the visual effect options on their surfaces; moreover, the remote control of the present invention can include new options with ease. Thereby the option expansion problems of the existing LED string remote controls can be solved, and the object of the present invention can be achieved.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A remote control for remotely controlling illumination of an LED string, including:

a control panel including:

a dial selector including a plurality of selection positions for selecting a color of a primary color light emitted by the LED string;

a plurality of primary color illumination mode buttons for selecting an illumination mode of the primary color light;

a plurality of background illumination mode buttons for selecting an illumination mode of a background color light emitted by the LED string to cooperate with the primary color light;

an illumination sequence button cooperating with the dial selector to select an illumination sequence of LED lamps in the LED string;

a control circuit including:

a wireless transmitter for transmitting an LED string control signal to control the LED string via an antenna;

a resistive divider circuit for providing a plurality of divided voltages to the dial selector, wherein the dial selector selects one of the plurality of divided voltages as an output voltage;

a plurality of switches, each of which having two ends and one button, wherein the buttons of the plurality of switches are either the primary color illumination mode buttons, the background illumination mode buttons, the illumination sequence button, or an on/off button, and the plurality of switches are configured to output state voltages;

a controller electrically connected to the wireless transmitter to provide the LED string control signal to the wireless transmitter, the controller electrically connected to the dial selector to receive the output voltage from the dial selector, and the controller electrically connected to the plurality of switches for detecting the state voltages of each of the plurality of switches, wherein the controller generates the LED string control signal according to both the output voltage of the dial selector and the state voltages output by the plurality of switches.

2. The remote control as claimed in claim 1, wherein the color of the primary color light includes: red, yellow, blue, green, cyan, purple or white.

3. The remote control as claimed in claim 1, wherein the color of the primary color light includes: any combination of red, yellow, blue, green, cyan, and purple.

4. The remote control as claimed in claim 1, wherein the illumination mode of the primary color light includes that the primary color light has a fixed color that does not change with time.

5. The remote control as claimed in claim 1, wherein the illumination mode of the primary color light includes that the primary color light has a fixed color that periodically and gradually gets brightened then dimmed.

6. The remote control as claimed in claim 1, wherein the illumination mode of the background color light includes that the primary color light cooperates with a flashing background color light.

7. The remote control as claimed in claim 1, wherein the illumination mode of the background color light includes that the primary color light cooperates with a flashing background white light.

8. The remote control as claimed in claim 1, wherein the illumination mode of the background color light includes that the primary color light and a randomly selected background color light are flashing alternately.

9. The remote control as claimed in claim 1, wherein the LED illumination sequence of the LED light string includes "sequentially on then reversely fading".

10. The remote control as claimed in claim 1, wherein the LED illumination sequence of the LED light string includes "in-wave twinkle forward and backward".

11. The remote control as claimed in claim 1, wherein the LED illumination sequence of the LED light string includes "sequentially blinking".

12. The remote control as claimed in claim 1, wherein the LED illumination sequence of the LED light string includes that the primary color light and another color light are together chasing.

13. The remote control as claimed in claim 1, wherein the LED illumination sequence of the LED light string includes that the primary color light and other two color lights are together chasing.

14. The remote control as claimed in claim 1, wherein the LED illumination sequence of the LED light string includes that the primary color light starting chasing from the middle of the LED string to its two ends.

15. The remote control as claimed in claim 1, wherein the LED illumination sequence of the LED light string includes "sequentially blinking and then sequentially off".

16. The remote control as claimed in claim 1, wherein the resistive divider circuit includes: a resistor string composed of a plurality of resistors connected in series, wherein the connection of any two of the serially connected resistors is designated as a voltage output node, and the resistor string has two end points electrically connected to a high voltage and a low voltage, respectively; and all the voltage output nodes plus the two end points of the resistor string output the divided voltages of the resistive dividing circuit.

17. The remote control as claimed in claim 1, wherein the state voltage includes: a digital high voltage, a ground potential, and a floating state voltage.

18. The remote control as claimed in claim 1, wherein the dial selector includes: an output terminal, a selection input end and a turntable; the select input end being rotatable with the turntable to electrically connect to the plurality of selection positions respectively to conduct one of the plurality of divided voltages to the output terminal as the output voltage of the dial selector.

* * * * *